United States Patent [19]

Halbach

[11] Patent Number: 4,549,155

[45] Date of Patent: Oct. 22, 1985

[54] PERMANENT MAGNET MULTIPOLE WITH ADJUSTABLE STRENGTH

[75] Inventor: Klaus Halbach, Berkeley, Calif.

[73] Assignee: The United States of America as represented by the United States Department of Energy, Washington, D.C.

[21] Appl. No.: 420,433

[22] Filed: Sep. 20, 1982

[51] Int. Cl.[4] ..... H01F 1/00

[52] U.S. Cl. ..... 335/212; 335/304; 335/306

[58] Field of Search ..... 335/302, 306, 301, 304, 335/210, 212

[56] References Cited

U.S. PATENT DOCUMENTS

| | | | |
|---|---|---|---|
| 2,895,092 | 7/1959 | Cluwen | 335/304 |
| 3,768,054 | 10/1973 | Neugebauer | 335/304 |
| 3,781,736 | 12/1973 | Parker | 335/304 |

*Primary Examiner*—George Harris

*Attorney, Agent, or Firm*—Patrick T. King; Clifton E. Clouse, Jr.; Judson R. Hightower

[57] ABSTRACT

Two or more magnetically soft pole pieces are symmetrically positioned along a longitudinal axis to provide a magnetic field within a space defined by the pole pieces. Two or more permanent magnets are mounted to an external magnetically-soft cylindrical sleeve which rotates to bring the permanent magnets into closer coupling with the pole pieces and thereby adjustably control the field strength of the magnetic field produced in the space defined by the pole pieces. The permanent magnets are preferably formed of rare earth cobalt (REC) material which has a high remanent magnetic field and a strong coercive force. The pole pieces and the permanent magnets have corresponding cylindrical surfaces which are positionable with respect to each other to vary the coupling therebetween. Auxiliary permanent magnets are provided between the pole pieces to provide additional magnetic flux to the magnetic field without saturating the pole pieces.

9 Claims, 4 Drawing Figures

PERMANENT MAGNET MULTIPOLE WITH ADJUSTABLE STRENGTH

The U.S. Government has rights 1n this invention pursuant to Contract No. DE-AC03-76SF00098 (formerly Contract No. W-7405-ENG-48) with the U.S. Department of Energy.

BACKGROUND OF THE INVENTION

1. Field of the Invention

This invention relates to variable field strength magnets and, more particularly, to multipole variable permanent magnets.

2. Prior Art

A number of techniques are available for producing variable-strength magnetic fields. Such fields are particularly useful in charged particle acclerators for bending and focusing of particle beams. Electromagnets, that is, devices which produce magnetic fields using electrical currents passing through ordinary or superconducting windings, have serious limitations for certain applications. One limitation is the large amounts of expensive electrical power that these systems consume either for the current to operate a conventional conductor or for cooling a superconductor. In addition, conventional electromagnets are limited to certain minimum volumes because their current densities are inversely proportional to their linear dimensions, which leads ultimately to insurmountable cooling problems. The result is that the currents for these electromagnets must be reduced for smaller sizes with consequently smaller magnetic fields.

And so it has been found that for many magnet applications it is often advantageous to use permanent magnets instead of electromagnets in order to eliminate windings with their consequent power consumption and to produce strong fields in physically small spaces. For magnets which are used in small spaces and which require large pole tip fields, it is very often difficult to provide enough copper cross-sectional area in the space available. An area where high-field permanent magnets find particular application is in the construction of small quadrupole magnets for guiding, focusing, and turning charged particle beams in linear accelerators used in atomic physics and medical treatment and research. A theoretical analysis is presented by J. B. Blewett in "Design of Quadrupoles and Dipoles Using Permanent Magnet Rings," Brookhaven National Laboratory Report No. AADD-89, Aug. 10, 1965. That report includes equations and analyses for maximizing the strength of a ring or cylindrical quadrupole permanent magnet using anisotropic material.

A technique for designing permanent magnet multipole magnets was disclosed in a paper by the present inventor, K. Halbach, "Design of Permanent Magnet Multipole Magnets with Oriented Rare Earth Cobalt Materials," *Nuclear Instruments and Methods* 169 (1980) pp 1–10. Disclosed therein is a quadrupole design which uses a number of magnetically anisotropic magnet segments, each having an easy axis, or axis of magnetic orientation, in a different predetermined direction. One proposed application of this design combines two multipole magnets such that one quadrupole is located within the aperture of the other. For the rare earth cobalt (REC) materials used, superposition of the individual magnetic fields is possible, and the fields of each quadrupole add or subtract depending upon their relative rotational positions. This design suffers from fringe fields at the ends of the magnet which combine to produce undesired perturbations in the beam optical properties of the magnet.

SUMMARY OF THE INVENTION

It is therefore an object of the invention to provide a multipole permanent magnet having an easily adjustable field strength.

It is another object of the invention to provide an adjustable multipole permanent magnet which maintains its field distribution substantially undisturbed as its strength is varied.

It is another object of the invention to provide a magnet having a variable field strength which does not consume electrical power.

It is another object of the invention to provide for continous variation in field strength of a multipole permanent magnet.

In accordance with these and other objects of the invention, a multipole permanent magnet structure is provided which has an adjustable field strength. Two or more spaced-apart magnetically-soft pole pieces are energized by one or more permanent magnets, which are characterized as having high remanent fields and strong coercive forces. One preferred group of materials which has these characteristics are the rare earth cobalt (REC) materials. In its broadest aspects, means are provided for variably coupling magnetic flux provided by the one or more permanent magnets to the pole pieces. This variable coupling is used to control the field strength of the magnetic field between the pole pieces while the field distribution of that magnetic field is maintained substantially constant.

According to one aspect of the invention, the variable coupling for magnetic flux of the permanent magnets to the pole pieces is obtained by the pole pieces and the permanent magnet each having surface areas which move relative to one another and which provide magnetic coupling therebetween when the surfaces are in close proximity. Movement of one surface with respect to another places various portions of the respective surface areas in close proximity to thereby control the magnetic field strength between the pole pieces.

In one preferred embodiment of the invention, permanent magnets are mounted for rotation on a magnetically-soft cylindrical sleeve which rotates around the pole pieces. Auxiliary permanent magnets provide additional magnetic flux to the pole pieces and corrector permanent magnets prevent coupling of undesired fields from the permanent magnets into the pole pieces.

The method according to the invention includes positioning of the pole pieces around an axis and exciting the pole pieces with one or more permanent magnets. Adjustment of the magnetic field strength on the space between the poles is accomplished by moving the permanent magnets with respect to the pole pieces to obtain various degrees of proximity to vary the magnetic coupling there-between.

One specific preferred embodiment is a symmetric quadrupole in which four pole pieces are symmetrically arranged around a longitudinal axis and four permanent magnets are mounted to a cylindrical sleeve surrounding the pole pieces. Corresponding cylindrical surfaces are formed on the pole pieces and the permanent magnets so that, as the sleeve is rotated, variable magnetic coupling is obtained.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawings, which are incorporated and form a part of the specification, illustrate an embodiment of the invention and, together with the description, serve to explain the principles of the invention. In the drawings:

FIG. 4 1s sectional view taken along section line 4—4 of FIG. 3.

DETAILED DESCRIPTION OF THE PREFERRED EMBODIMENT

Reference is now made in detail to the present preferred embodiment of the invention which illustrates the best mode presently contemplated by the inventor of practicing the method and apparatus of the invention, a preferred embodiment of which is illustrated in the accompanying drawings.

As indicated above, for certain application a very important advantage of a permanent magnet over an electromagnet is that permanent magnets can be made very small without sacrificing magnetic field strength. Recall that the current density of an electromagnet is inversely proportional to the size of the magnet. Currently available oriented rare earth cobalt (REC) materials produce magnetic fields that are at least as strong as those produced by conventional electromagnets of any arbitrary size. In comparison to other more conventional magnetic materials, REC materials have relatively simple characteristics which are easy to understand and to treat analytically. These characteristics have made REC materials good candidates for improved magnet designs such as described in this specification.

The process by which REC materials are produced is briefly described for purposes of understanding its characteristics. A molten mixture of approximately five parts cobalt to one part of a rare earth, such as samarium, is rapidly cooled and then crushed and milled to yield crystalline particles having dimensions on the order of 5 micrometers. These crystalline particles are highly anisotropic and have a preferred magnetic polarization direction in one crystalline direction. A very strong magnetic field is applied which causes the individual particles to physically rotate until their magnetically preferred axes are aligned parallel to the applied magnetic field. Pressure is applied to form manageable blocks of material and the aligned blocks of material are then sintered and finally subjected to a very strong magnetic field in a direction parallel or antiparallel to the previously established preferred magnetic direction to reestablish full magnetization. This aligns almost all of the magnetic moments in the direction of magnetization called the easy axis. The particular characteristic that makes REC so useful is that this remament magnetic field is extremely strong and can be changed only by applying a strong magnetic field in the direction opposite to the field originally used to magnetize the REC material.

Figure 1:
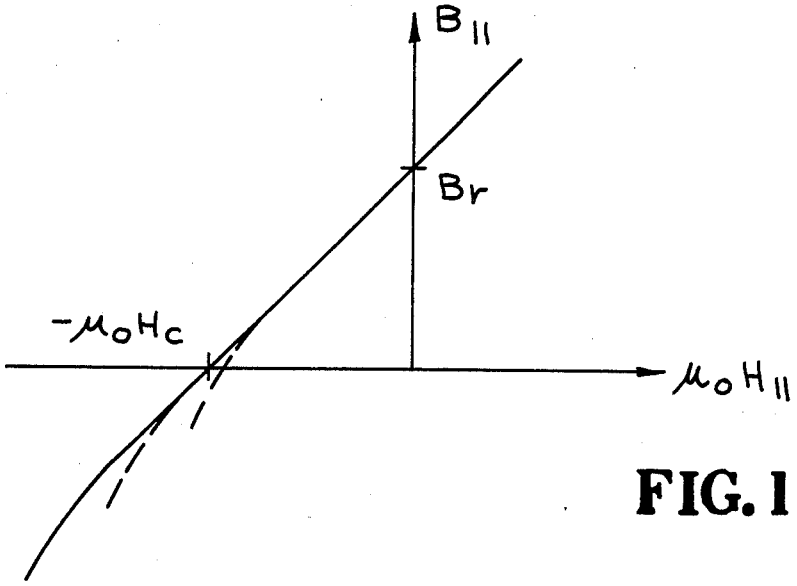
FIG. 1. is B-H curve for a rare earth cobalt (REC) material taken in the direction parallel to the easy axis thereof.

Referring now to the drawings, FIG. 1 shows the B-H curve taken in the direction of the so-called easy axis for a rare earth cobalt (REC) material. This curve has several important features. It is practically a straight line over a wide range of field strengths and has a slope near unity. The offset of the curve from the origin, that is the remanent field $B_r$ is typically 0.8 to 0.95 Tesla with the coercive field about 4 to 8 percent less than the remanent field. This linearity over a wide range of field strengths and the differential permeability close to unity permits this type of material to be treated as a vacuum with an imprinted charge or current density. The consequence of this is that fields produced by different pieces of REC material superimpose linearly and that this field can be analytically determined quite easily in the absence of magnetically soft material, that is, materials which are linear and which have no hysteresis.

There are several other materials which have properties similar to REC material, which include resin-bonded REC material and some of the oriented ferrites, but these have lower remanent fields and larger permeabilities. These materials can be used to practice the invention disclosed herein and it is intended that these materials be generically included with the REC materials to practice the preferred embodiments of the invention.

Figure 2:
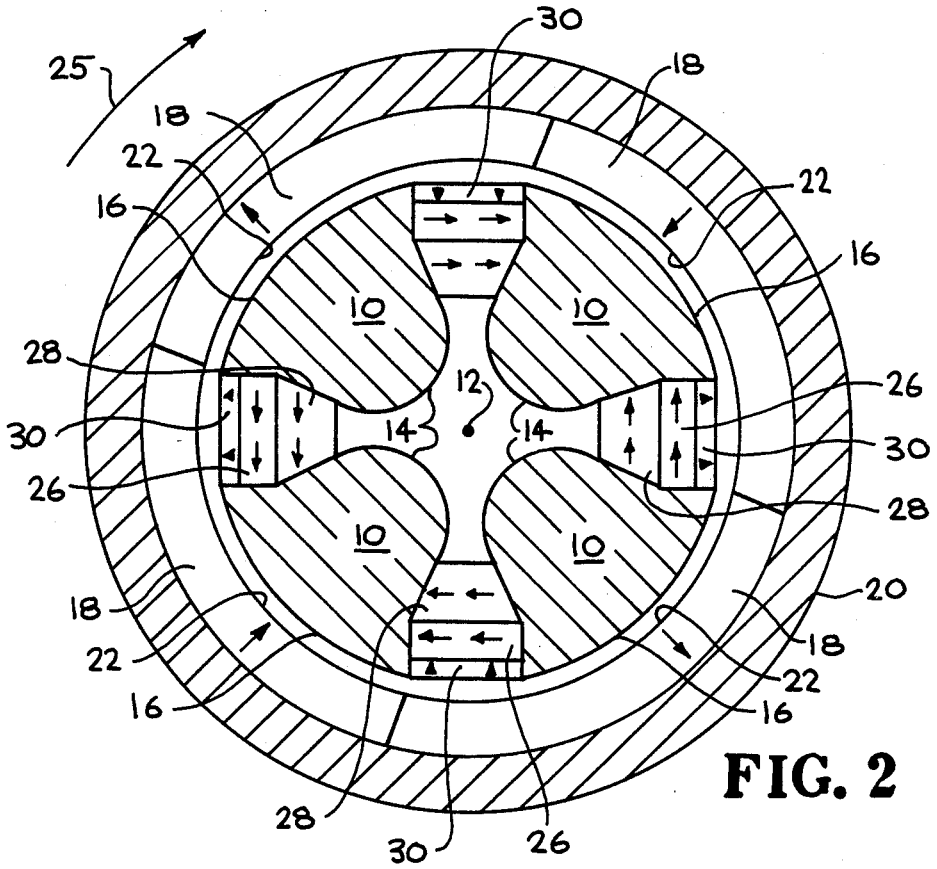
FIG. 2. is a diagrammatic sectional view of a quadrupole permanent magnet having a variable field strength in the space provided in the center thereof.

Referring now to FIG. 2 of the drawings, a quadrupole version of the invention is shown in diagrammatic form as a typical radial section through a cylindrical prism.

A multipole field magnetic field is generically a two-dimensional field that is dependent on two directional coordinates and that is independent of the third directional coordinate. The strength of such a field is proportional to an integer power of r where r is the shortest distance from the point under consideration to the axis extending in the third direction. For a quadrupole field, the field strength is directly proportional to r.

A quadrupole configuration is described as a preferred configuration of this invention, but it should become readily apparent that any multipole configuration desired, that is, dipole, octupole, etc. or any combination thereof to achieve special field configurations, can be provided and the invention is applicable thereto.

Four pole pieces 10 of magnetically-soft iron or steel material are arranged as shown around a central axis 12 extending perpendicularly to the plane of the figure. The pole pieces symmetrically extend in directions parallel to the axis 12 and have similar cross sections at various points along that axis. Each pole piece has a pole tip portion 14, which for a quadrupole, has a hyperbolic configuration which is blended into a straight side, as shown, to provide an optimized field distribution. The rear surfaces 16 of the pole pieces are shaped as portions of cylindrical surfaces.

Four permanent magnets 18 formed of a number of bars of suitable rare earth cobalt (REC) material, or material having similar high remanent field characteristics, are fixed with a suitable adhesive material to the inner surface of a cylindrical sleeve 20. The direction of the magnetic flux provided by each of the permanent magnets is indicated by an arrow which represents the easy axis of each magnet. The sleeve 20 is formed of magnetically-soft material and provides a flux path between the various permanent magnets 18. The inner surfaces 22 of the permanent magnets 18 are cylindrically shaped as shown to correspond to the cylindrical shapes of the rear surfaces 16 of the pole pieces 10. These surfaces 16,22 provide a means for coupling the magnetic flux of the permanent magnets 18 to the pole pieces 10. This coupling is variable because, as the sleeve 20 is rotated, varying amounts of surface areas are placed in close proximity such that the magnetic flux provided by the permanent magnets 18 passes through the small air gap therebetween and is coupled from the permanent magnets 18 to the pole pieces 10. The pole pieces 10 provide a magnetic path for this flux to the pole tips 14 which are shaped to distribute the flux in the space provided between the pole pieces along the axis 12. Thus by rotating the position of the permanent magnets 18 in the direction indicated by arrow 25 from the starting position as shown in FIG. 2, the field strength of the field can be adjusted over a range to a desired value for a particular application without disturbing the field distribution. This is possible because the permanent magnets 18 are formed of REC material, that is, material with a high remanent field and a strong coercive force.

FIG. 2 also shows four auxiliary permanent magnet assemblies composed of a first auxiliary magnet 26 having a rectangular cross section and a second auxiliary magnet 28 having a trapezoidal cross section. Both are formed of REC material, and are fixed in position between the pole pieces 10. The direction of the easy axes are indicated by the arrows and indicate the direction of the magnetic fields provided by these magnets. The auxiliary permanent magnets 26,28 provide additional magnetic flux to the respective pole tips 14. This permits strong magnetic fluxes to be available at the pole tips 14 while preventing saturation of the pole pieces 10.

It should be appreciated that the net magnetic flux supplied to the pole tip 14 of a particular permanent magnet 10 varies depending on the rotational position and the polarity of the permanent magnets 18 and depending on the polarity of the fixed auxiliary permanent magnets 26,30.

Corrector permanent magnets 30 formed from slabs of REC material are fixed adjacent the pole pieces near the permanent magnets 18. The corrector permanent magnets 30 are chosen to have thicknesses and magnetic field strengths and directions which oppose undesired permanent magnet fields which might enter the sides of the pole pieces and upset the symmetry of a quadrupole field.

Figure 3:
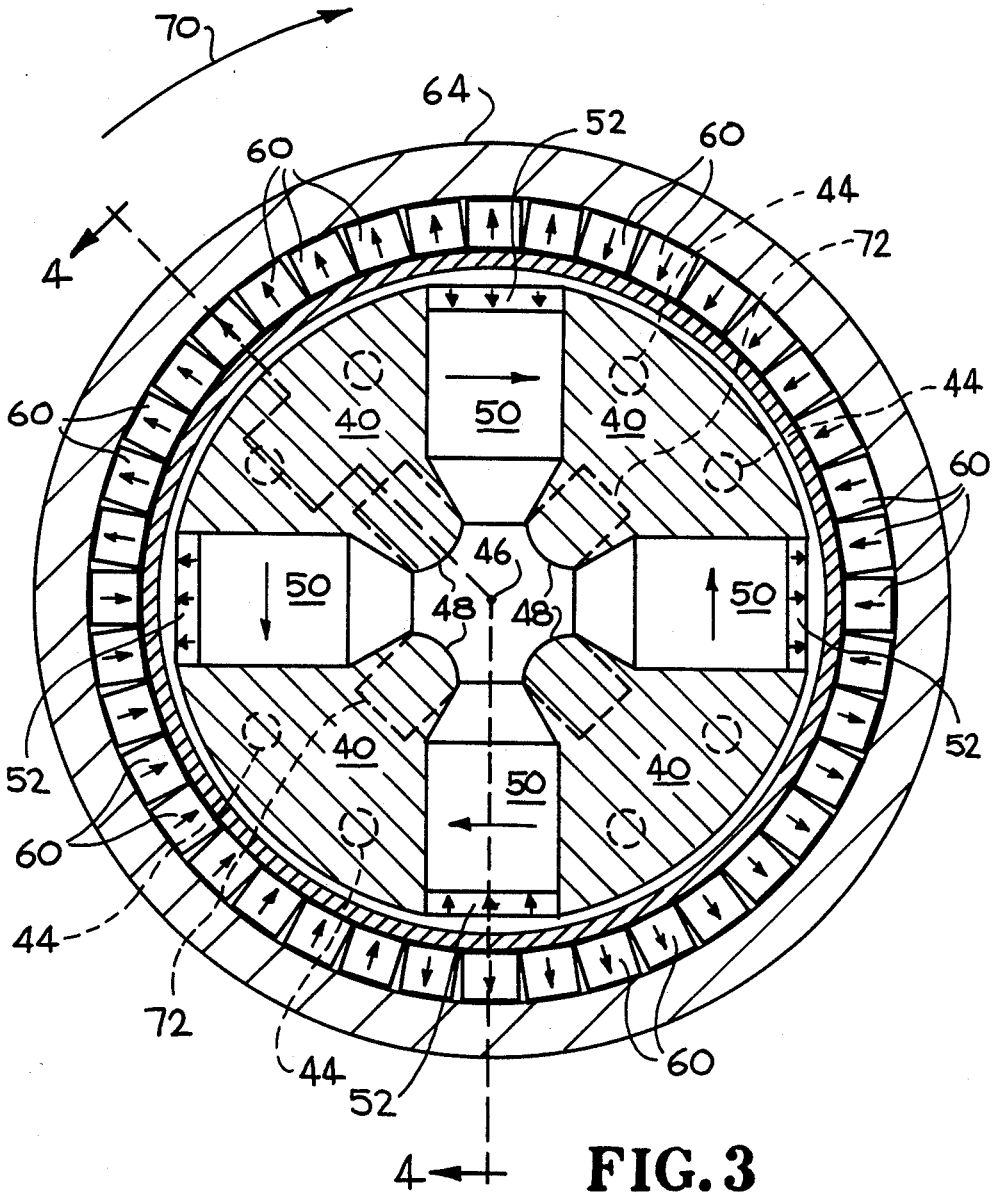
FIG. 3 is a cross-sectional view of an embodiment of a variable quadrupole permanent magnet structure according to the invention.
Figure 4:
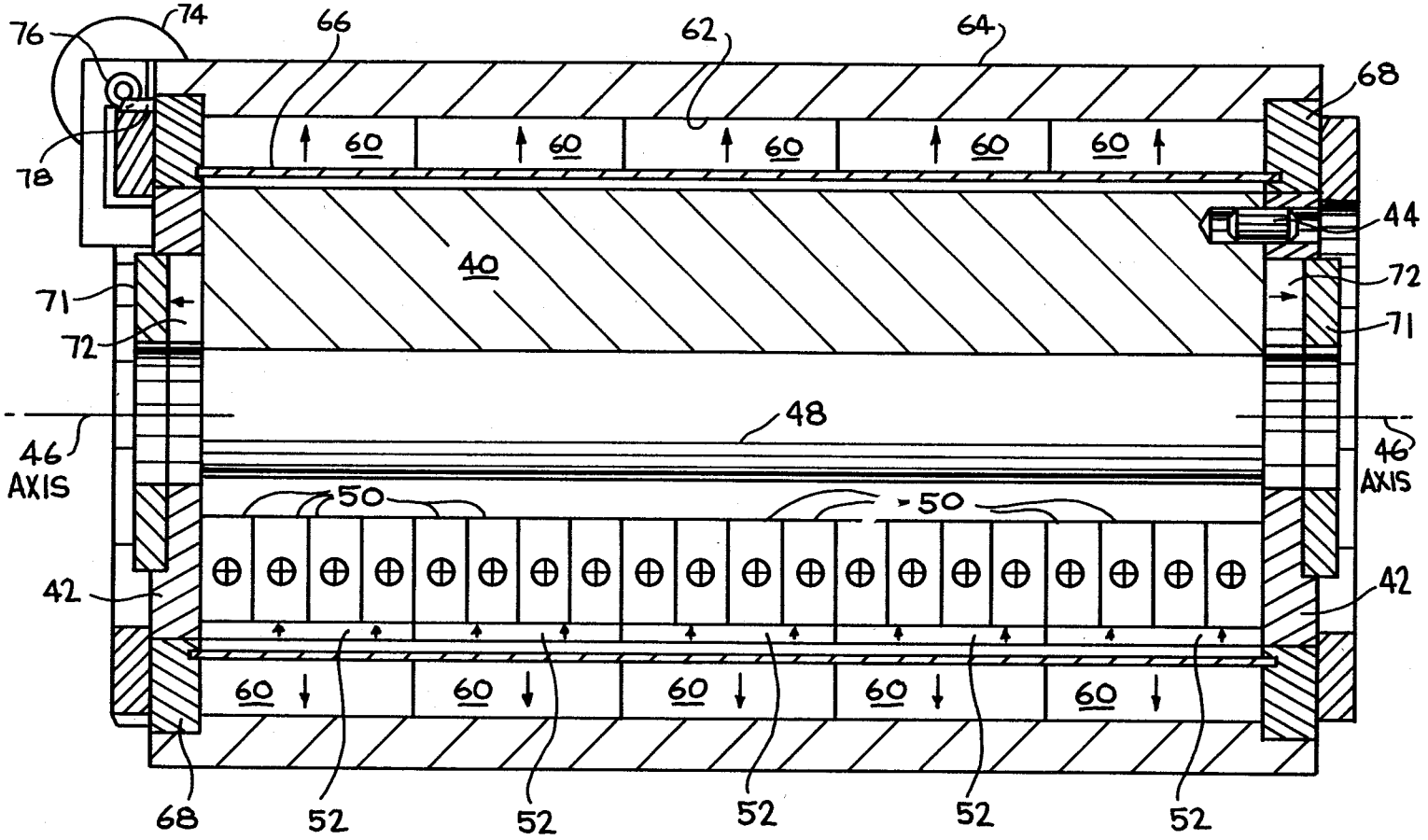

Referring now to FIGS. 3 and 4 of the drawings, a preferred embodiment of a quadrupole variable-strength permanent magnet is shown. This preferred embodiment is very similar to that shown in FIG. 2 with the addition of certain functional details to facilitate the making and using thereof.

Four magnetically-soft pole pieces 40 are mounted at each end to two nonmagnetic disc-shaped end plates 42 with a series of pins 44 wedged into corresponding holes in the pole pieces 40 and the end plates 42. The end plates 42 are adapted to have suitable support structure attached thereto for mounting the quadrupole magnet in position, for example, in a charged-particle beam line which sends particles along a longitudinal axis 46. The quadrupole magnet serves as part of a magnetic means for focusing the particle beams.

Each of the pole pieces 40 has a hyperbolically-shaped pole tip 48 positioned along the axis 46 to provide a magnetic field within the space defined by those symmetrically spaced-apart pole tips. Four auxiliary permanent magnet assemblies are formed from a series of REC magnets 50 having rectangular cross sections. The magnets 50 are fixed in position between the pole pieces 40 by a suitable adhesive material. The auxiliary magnets 50 are formed of REC material having easy axes as indicated to provide magnetic flux to the pole tips 48.

As shown in FIG. 4, a series of elongated REC bars 60 having rectangular cross sections are fixed with a suitable adhesive material to the interior surface 62 of a magnetically-soft cylindrical sleeve 64 to form the four permanent magnets. The interior surfaces of the permanent magnets formed by the bars 60 are located next to a nonmagnetic inner sleeve 66. The ends of the inner sleeve 66 are fixed within corresponding slots on the inside walls of a pair of sleeve-mounting flanges 68, which also mount the ends of the the magnetically-soft cylindrical sleeve 64 for rotation about the longitudinal axis 46. The inner surfaces of the flanges 68 engage the outer surfaces of the disk-shaped mounting plates 42 with the interface therebetween serving as a rotational bearing for the sleeve 64 and the attached permanent magnets 60.

Corrector permanent magnets 52 formed of slabs of REC material and oriented as indicated are fixed adjacent and between the pole pieces 40 near their outer edges and close to the permanent magnet bars 60. The corrector permanent magnets 52 have magnetic field strengths which oppose undesired fields from the permanent magnets which might enter the sides of the pole pieces near their interfaces with the auxiliary permanent magnets 50. These undesired fields would upset to some degree the symmetry of the quadrupole for certain rotational positions of the permanent magnets as the cylindrical sleeve 64 is rotated in the direction of arrow 70 beginning, for example, from the starting position shown in FIG. 3.

Fixed to each end plate 42 is a magnetically-soft shield plate 71 which is coupled to each of the pole pieces 40 through four blocks 72 of REC material. This shields the ends of quadrupole structure from stray external fields and confines and shapes the magnetic field of the quadrupole near its ends.

FIG. 4 shows a means for rotating the cylindrical sleeve 64 which includes a stepper-motor 74 driving a backlash free worm 76 which engages a ring gear 78 fixed to the sleeve-mounting flange 68. The position of the permanent magnets 60 with respect to the pole pieces is controlled by the stepper motor to thereby obtain a desired magnetic field strength for the quadrupole.

The foregoing description of a preferred embodiment of the invention has been presented for purposes of illustration and description. It is not intended to be exhaustive or to limit the invention to the precise forms disclosed, and obviously many modifications and variations are possible in light of the above teachings. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto and their equivalents.

What is claimed is:

1. A multipole permanent magnet structure for guiding, focusing and turning charged particle beams, said structure having an adjustable field strength and a substantially constant magnetic field distribution, comprising:

a first pole piece and a second pole piece, each formed of magnetically-soft material, each pole piece having a pole tip, said pole pieces being spaced-apart to permit a magnetic field to be established between the pole tips, said pole pieces being arranged about a longitudinal axis to provide a cylindrical multipole structure having a central space formed between the pole tips and extending along the longitudinal axis for passage of a charged particle beam through the space;

first and second permanent magnets having high remanent fields and strong coercive forces, said permanent magnets being mounted in close proximity to the rear of said pole pieces and magnetically coupled thereto to thereby establish a magnetic field between said pole tips;

means for moving the permanent magnets with respect to the pole pieces to vary the coupling between the pole pieces and the permanent magnets so that the flux denisity of the magnetic field between the pole tips is correspondingly varied, while the magnetic field distribution between the pole tips is maintained substantially constant.

2. The magnet structure of claim 1 including a magnetically-soft sleeve to which the permanent magnets are fixed and which is rotatable about the rear of the pole pieces.

3. The magnet structure of claim 1 including auxiliary permanent magnets having high remanent fields and strong coercive forces and positioned between the pole pieces to provide additional magnetic flux to the pole pieces and, for strong magnetic fluxes, preventing saturation of the pole pieces.

4. The magnet structure of claim 1 including a corrector permanent magnet positioned between the pole pieces such that its magnetic field opposes and prevents coupling of undesired magnetic fields from the permanent magnet into the pole pieces.

5. The magnet structure of claim 1 including a plurality of symmetrically arranged pole pieces and a plurality of permanent magnets which form a symmetric variable-strength multipole magnet, said plurality of permanent magnets being greater in number than said pole pieces.

6. The magnet structure of claim 5 including:

four pole pieces arranged around the longitudinal axis and defining the space extending along the longitudinal axis, each pole piece having a cylindrical rear surface, four permanent magnets having cylindrical surfaces matching the cylindrical rear surfaces of the pole pieces, said permanent magnets being movable with respect to the pole pieces; and a magnetically-soft sleeve providing magnetic coupling between the four permanent magnets.

7. The magnet structure of claim 6 including four auxiliary permanent magnets positioned between adjacent pole pieces to provide additional magnetic flux to the pole pieces.

8. The magnet structure of claim 1 wherein the permanent magnets are formed of material including rare earth cobalt material.

9. The magnet structure of claim 1 including a plurality of permanent magnet blocks and a magnetic shield plate positioned at the end of the permanent magnet structure and coupled to each of the pole pieces through one of the blocks of permanent magnet material.

* * * * *